US008141531B2

(12) United States Patent
Smith et al.

(10) Patent No.: US 8,141,531 B2
(45) Date of Patent: Mar. 27, 2012

(54) VALVE COVER WITH DECOUPLED NVH ISOLATION AND SEALING FEATURES

(75) Inventors: Thomas Edward Smith, Livonia, MI (US); Abdelkrim Zouani, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 599 days.

(21) Appl. No.: 12/191,918

(22) Filed: Aug. 14, 2008

(65) Prior Publication Data

US 2010/0037848 A1 Feb. 18, 2010

(51) Int. Cl.
*F01M 9/10* (2006.01)

(52) U.S. Cl. ..... 123/90.38; 123/193.5; 123/198 E; 123/195 C; 181/204

(58) Field of Classification Search ..... 123/195 C, 123/198 E, 193.5, 90.37, 90.38; 277/313, 277/591, FOR. 248, 944, 922, 945; 29/888.01, 29/888.06, 888.3; 181/205, 206, 208, 204
See application file for complete search history.

(56) References Cited

U.S. PATENT DOCUMENTS 3,692,335 A * 9/1972 Vickers et al. ..... 285/49
3,773,142 A * 11/1973 Bragg et al. ..... 181/204
3,822,763 A * 7/1974 Adams et al. ..... 181/204
4,027,644 A * 6/1977 Timour ..... 123/198 E
5,536,018 A 7/1996 Szott
5,957,100 A 9/1999 Frohwerk et al.
6,085,709 A * 7/2000 Freese ..... 123/90.38
6,161,879 A * 12/2000 Ries et al. ..... 285/330
6,371,073 B1 4/2002 Billimack et al.
6,896,098 B2 * 5/2005 Vom Stein et al. ..... 181/204
7,316,215 B1 1/2008 Nino et al.
7,827,950 B2 * 11/2010 Hu et al. ..... 123/90.38
2005/0193972 A1 * 9/2005 vom Stein ..... 123/90.38

* cited by examiner

*Primary Examiner* — Noah Kamen
*Assistant Examiner* — Hung Q Nguyen
(74) *Attorney, Agent, or Firm* — Allan J. Lippa; Alleman Hall McCoy Russell & Tuttle LLP

(57) ABSTRACT

A cylinder head cover, a system, and a method are disclosed for sealing a cylinder head and isolating cylinder head vibrations from a cylinder head cover body. An example cylinder head cover may include a bottom carrier having a first end configured to be disposed in sealing engagement with a cylinder head. The bottom carrier may also have a second end. A cover body may be configured to provide a covering surface, and may have a side wall extending toward the cylinder head. A resilient joining element may connect the bottom carrier second end to an edge of the cover body side wall in sealing engagement. An example method may include positioning a substantially rigid bottom carrier on the cylinder head, the bottom carrier including a sealing member configured for sealing engagement with the cylinder head; sealingly connecting a membranoid elastomeric joining element to the bottom carrier; connecting the cylinder head body to the joining element; and forming a substantially continuous sealing membrane with a combination of the bottom carrier the joining element and the cylinder head body.

25 Claims, 3 Drawing Sheets

VALVE COVER WITH DECOUPLED NVH ISOLATION AND SEALING FEATURES

BACKGROUND/SUMMARY

Many gasoline and diesel cylinder head covers are isolated systems. The covers may be balanced between elastomeric isolator grommets and an elastomeric perimeter gasket. One approach to improve sealing capability is to increase the overall stiffness of the isolation system. However, increasing stiffness of the isolation system may increase Noise Vibration and Harshness (NVH) of the engine and/or cylinder head cover. Conversely, decreasing stiffness of the isolation system may increase the risk of oil leaks.

As one example compromise between sealing and stiffness, U.S. Pat. No. 6,371,073 to Billimack et al. discloses a cover member having a peripheral flange portion fixedly secured to an upstanding wall portion of an engine cylinder block. A sealing flange member is interposed between the peripheral flange and the upstanding wall portion. In addition, an isolation member, fabricated from an elastomeric material, is interposed between the sealing flange member and the peripheral flange. The three piece assembly, i.e. the peripheral flange portion, the isolation member, and the sealing flange member, is then secured to the upstanding wall portion with a plurality of bolts.

However, the inventors herein have recognized several issues with such an approach. As one example, the approach requires the addition of an upstanding wall portion to be added to the surface of the engine block, which may increase manufacturing costs, and affect the vibration characteristics of the engine block.

Thus, in one example, the above issues may be addressed by a cylinder head cover for an internal combustion engine wherein the sealing function and the NVH isolation function are decoupled from one another. The cylinder head cover may include a bottom carrier having a first end configured to be disposed in sealing engagement with a cylinder head. The bottom carrier may also have a second end. A cover body may be configured to provide a covering surface, and may have a side wall extending toward the cylinder head. A resilient joining element may connect the bottom carrier second end to an edge of the cover body side wall in sealing engagement.

The bottom carrier may serve to seal the cylinder head cover at a juncture between the cylinder head and the bottom carrier first end. By connecting the bottom carrier to the edge of the cover body at the second end of the bottom carrier, i.e. spaced from the first end, the sealing function and the NVH isolation function may be separated, and may be individually optimized. Further the joining member may serve to provide both a portion of the covering function of the cylinder head cover, and at least a portion of the NVH isolation functionality. In this way an efficient, and cost effective, structure may be provided.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF DRAWINGS

FIGS. 2, 3A and 3B are drawn approximately to scale. Other embodiments within the scope of this disclosure, but not illustrated, may have other relative sizes.

DETAILED DESCRIPTION

A valve cover for an internal combustion engine is described having spaced apart and/or separate sealing and NVH isolation functions. In this way each of the functions may be optimized.

In various embodiments, the perimeter of the cylinder head cover may be hard mounted to the cylinder head. This may enable a sealing gasket to be hard mounted onto the cylinder head. This may provided improved sealing performance. This may also enable a gasket with a smaller gasket cross-section to be used. The improved sealing performance may also enable larger fastener spans, and therefore fewer fasteners to be used.

In various embodiments the NVH isolation may be moved up the cover. This may enable the NVH isolation to be optimized, and therefore improved NVH performance. Embodiments may enable elimination of the elastomeric grommet, and the isolator sleeve that may be otherwise be required.

Figure 1:
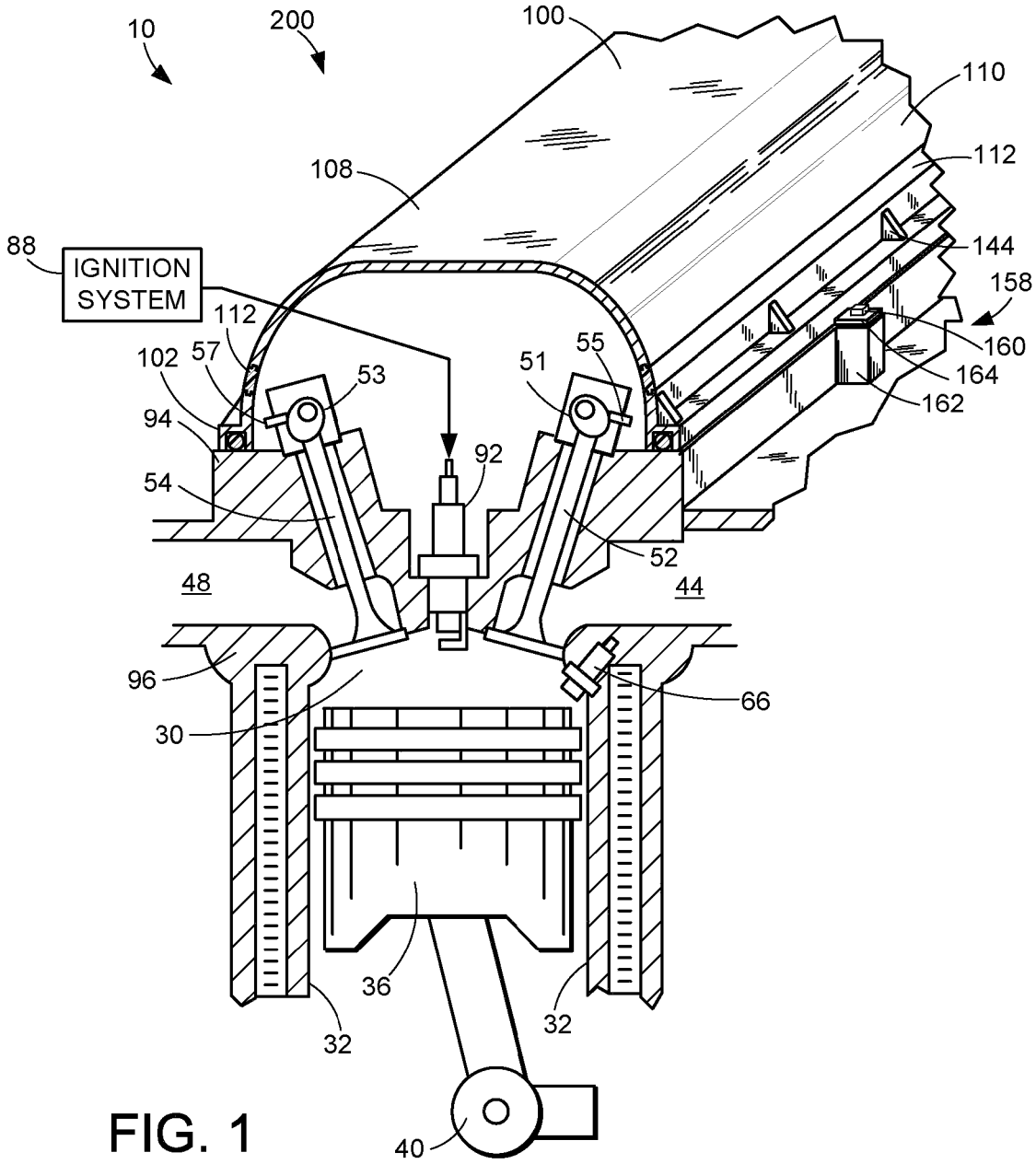
FIG. 1 shows a combination cross-sectional and isometric depiction of one cylinder in an internal combustion engine configured to propel a vehicle, with a cylinder head cover configured in accordance with various embodiments.

Referring now to FIG. 1, it shows a combination cross sectional and isometric diagram. FIG. 1 shows one cylinder of multi-cylinder engine 10, which may be included in a propulsion system of a vehicle. Engine 10 may be controlled at least partially by a control system that may include a controller (not shown), and by input from a vehicle operator via an input device such as an accelerator pedal. Combustion chamber (i.e. cylinder) 30 of engine 10 may include combustion chamber walls 32 with piston 36 positioned therein. Piston 36 may be coupled to crankshaft 40 so that reciprocating motion of the piston 36 is translated into rotational motion of the crankshaft 40. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from an intake manifold 44, and may exhaust combustion gases via exhaust passage 48. Intake manifold 44 and exhaust passage 48 may selectively communicate with combustion chamber 30 via respective intake valve 52 and exhaust valve 54. In some embodiments, combustion chamber 30 may include one or more intake valves and/or one or more exhaust valves.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by the controller to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion chamber 30 for injecting fuel directly therein in proportion to a pulse width of a signal that may be received from the controller. In this manner, fuel injector 66 provides what is known as direct injection of fuel into combustion chamber 30. The fuel injector 66 may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake passage 44 in a configuration that provides what is known as port injection of fuel into the intake port upstream of combustion chamber 30.

Ignition system 88 may provide an ignition spark to combustion chamber 30 via spark plug 92 in response to a spark advance signal SA from the controller, under select operating modes. Though spark ignition components are shown, in some embodiments, combustion chamber 30 or one or more other combustion chambers of engine 10 may be operated in a compression ignition mode, with or without an ignition spark.

Cylinder head 94 may be coupled to a cylinder block 96. The cylinder head 94 may be configured to operatively house, and/or support, the intake valve(s) 52, the exhaust valve(s) 54, and the associated valve actuation systems 51 and 53 and the position sensors 55 and 57, and the like. Other components, such as spark plug 92 may also be housed and/or supported by the cylinder head 94. The cylinder block 96 may be configured to house the piston 36.

As described above, FIG. 1 shows only one cylinder of a multi-cylinder engine, and that each cylinder may similarly include its own set of intake/exhaust valves, fuel injector, spark plug, etc. Engine 10 as illustrated and described herein may be included in a vehicle such as a road automobile, among other types of vehicles. In some examples, engine 10 may be included as a portion of a hybrid propulsion system including one or more other motors or engines, such as in the case of a hybrid electric vehicle (HEV). While the example applications of engine 10 will be described with reference to a vehicle, it should be appreciated that engine 10 may be used in other applications not necessarily confined to vehicle propulsion systems.

Figure 2:
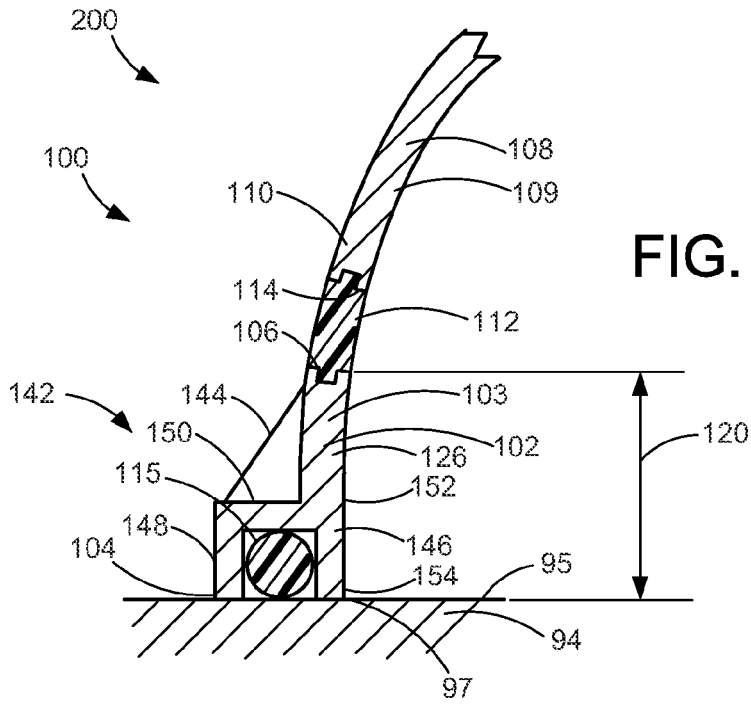
FIG. 2 shows a detailed cross-sectional depiction of the cylinder head cover shown in FIG. 1.

FIG. 1 also shows a cylinder head cover 100 for an internal combustion engine, and FIG. 2 shows a blowup view of a portion of a cylinder head cover 100. Example relative sizing is shown in FIG. 2, which is drawn approximately to scale. The cylinder head cover 100 may include a bottom carrier 102 having a first end 104 configured to be disposed in sealing engagement with the cylinder head 94. The bottom carrier 102 may also have a second end 106. A cover body 108 may be configured to provide a covering surface and having a side wall 110 extending toward the cylinder head 94. A resilient joining element 112 may connect the bottom carrier second end 106 to a connecting edge 114 of the cover body side wall 110 in sealing engagement. The cylinder head cover 100 may have a top surface 95 that may be substantially flat at an interface 97, or juncture, with the first end 104 of the bottom carrier 102.

The bottom carrier 102 may be configured to couple with and/or to partially house a gasket 115. The gasket 115 may be held adjacent the cylinder head 94 in sealing engagement with the cylinder head 94.

The joining element 112 may have a membranoid structure. A combination of the bottom carrier 102, the joining element 112, and the cover body 108 may form a substantially continuous seal over the cylinder head 94. The joining element 112 may provide at least some vibration isolation between the bottom carrier 102, and the cover body 108 at a spaced apart distance 120 from the bottom carrier first end 104. In this way the sealing features, for example the gasket 115 may be made a stiff as may be necessary to provide effective sealing properties, and the isolation features, for example the joining element 112 may be made as soft as may be necessary to provide effective NVH isolation properties.

Figure 3A:
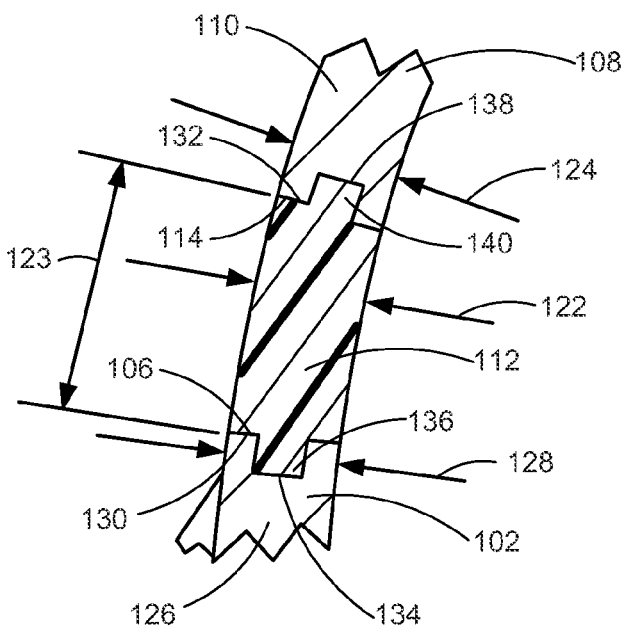
FIG. 3A is a blown up detailed view of portions of FIG. 2.
Figure 3B:
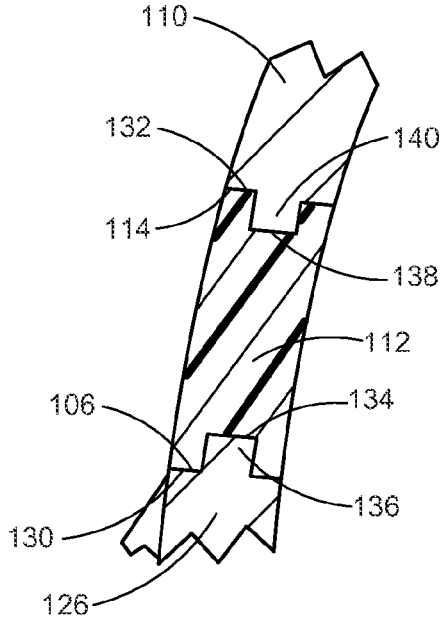
FIG. 3B is a view similar to FIG. 3A, but illustrating modifications that may be included in other embodiments.

FIG. 3A is a blown up detailed view of portions of FIG. 2, and FIG. 3B is a view similar to FIG. 3A, but illustrating modifications that may be included in other embodiments. The joining element 112 may have a joining element thickness 122 and the cover body side wall 110 may have a side wall thickness 124 substantially equal to the joining element thickness 122. The bottom carrier 102 may include an extension portion 126 configured to extend away from the cylinder head 94. The extension portion 126 may have an extension portion thickness 128 that may be substantially equal to the joining element thickness. In this way the NVH from the cylinder head 94 may be effectively absorbed, and the cylinder head cover 100 may tend do use engine space effectively.

The joining element 112 may span a spanning distance 123. In various embodiments the spanning distance 123 may be greater than the joining element thickness 122. In some embodiments the spanning distance 123 may be two or three or more times the joining element thickness 122.

The bottom carrier second end 106 may be bonded to the joining element 112 at a joining element first edge 130, and the cover body side wall 110 may be bonded to the joining element 112 at a joining element second edge 132. The bonding may be done via adhesives, welding, using fasteners, and the like.

FIG. 3A and FIG. 3B also illustrate example configurations for various surfaces that may be joined to form the cylinder head cover 100 in accordance with various embodiments. For example, one of the bottom carrier second end 106 or the joining element first edge 130 may have a first notched profile 134 and the other of the bottom carrier second end 106 or joining element first edge 130 may have a first protrusion 136 configured to matingly fit within the notched profile 134.

In addition, or alternatively, one of the joining element second edge 132 and the side wall connecting edge 114 may have a second notched profile 138 and the other of the joining element second edge 132 and the side wall connecting edge 114 may have a second protrusion 140 configured to matingly fit within the notched profile 138.

As illustrated FIG. 3A shows a first protrusion 136 and a second protrusion 140 on the joining element 112. FIG. 3B shows a first protrusion 136 on the bottom carrier 102 and a second protrusion 140 on the cover body 108 side wall 110. Other joining surface profiles with corresponding mating features may be used. For example, without limitation, joining surface profiles that may have more than one notch, may be straight, V-shaped, curvilinear, slotted, or dove-tailed.

Referring in particular to FIG. 2, the cylinder head cover 100 may include an upper portion 109 and a lower portion 103 coupled together by a flexible joining element 112 wherein the upper portion 109 and the lower portion 103 may be coupled together only by the joining element 112. The lower portion 103 may be the bottom carrier 102 and the upper portion 109 may be the cover body 108. The joining element 112 may be disposed to form a continuous band around the cylinder head cover 100, and may be configured for completely separating the lower portion 103 from the upper portion 109. The gasket 115 may be configured to be held in sealing engagement with a cylinder head by the lower portion 103.

Now, referring more specifically again to FIGS. 1 and 2 the Figs. also show a cylinder head covering system 200 for covering a cylinder head 94 of an internal combustion engine 10. The system 200 may include a substantially rigid bottom carrier 102 configured for sealing engagement at a first end 104 with the cylinder head 94. The bottom carrier 102 may have an extension portion 126 extending away from the cylinder head 94 toward a second end 106 disposed a distance 120 from the first end 104. A joining element 112 may have a first edge 130 fastened to the bottom carrier second end 106, and may have an opposite second edge 132. The joining element 112 may form a membrane between the first edge 130 and the second edge 132. The joining element 112 may be made from a resilient material. A cover body 108 may be fastened to the joining element second edge 132.

With this system 200 the bottom carrier 102, the joining element 112, and the cover body 108 may collectively form a sealing cover over the cylinder head 94. The distance 120 from the first end 104 may be sufficient to include a sealing housing 142 that may be configured to provide for the sealing engagement and to provide for a stiffening structure. The stiffening structure may include a number of stiffening elements 144 spaced along a perimeter of the bottom carrier 102.

FIG. 1 also illustrates one of two or more fastener arrangements 158 that may be configured to secure the cylinder head covering system 200 to the cylinder head 94. Fastener arrangement 158 may include a fastener 160, for example a bolt or a screw or the like, coupled with an attachment mount 162 which may be coupled with the cylinder head 94. The fastener 160 may pass through a mounting flange 164 coupled with, fastened to, or made integral with, the bottom carrier 102. The stiffening structure may enable an efficient sealing function that may then enable the fastener arrangements 158 to be spaced relatively far apart.

In various embodiments the sealing housing 142 may be configured to house a gasket 115 configured to provide the sealing engagement of the bottom carrier 102 with the cylinder head 94. The sealing housing 142 may include an inside wall 146 configured to extend from the cylinder head 94, and an outside wall 148 spaced from the inside wall 146, and disposed substantially parallel with the inside wall 146. A joining flange 150 may be configured to join the outside wall 148 to the inside wall 146. The extension portion 126 may be made substantially integrally with the inside wall 146 and may have an inside surface 152 disposed substantially coplanar with an inside surface 154 of the inside wall 146.

In various embodiments the cylinder head covering system 200 may further include one or more stiffening elements 144 extending from the joining flange 150 to the extension portion 126. In this way the stiffening elements 144 may provide additional strength to the bottom carrier 102, and may help provide a separation between the sealing function of the cylinder head covering system 200 and the NVH isolation function of the cylinder head covering system 200.

In various embodiments the cover body 108 may be made from a thermoplastic. In the same, or in other embodiments, the joining element 112 may be made from an elastomeric material. The joining element 112 may be integrated into the valve covering system 200 to provide at least a portion of the enclosing characteristics of the valve covering system 200.

Figure 4:
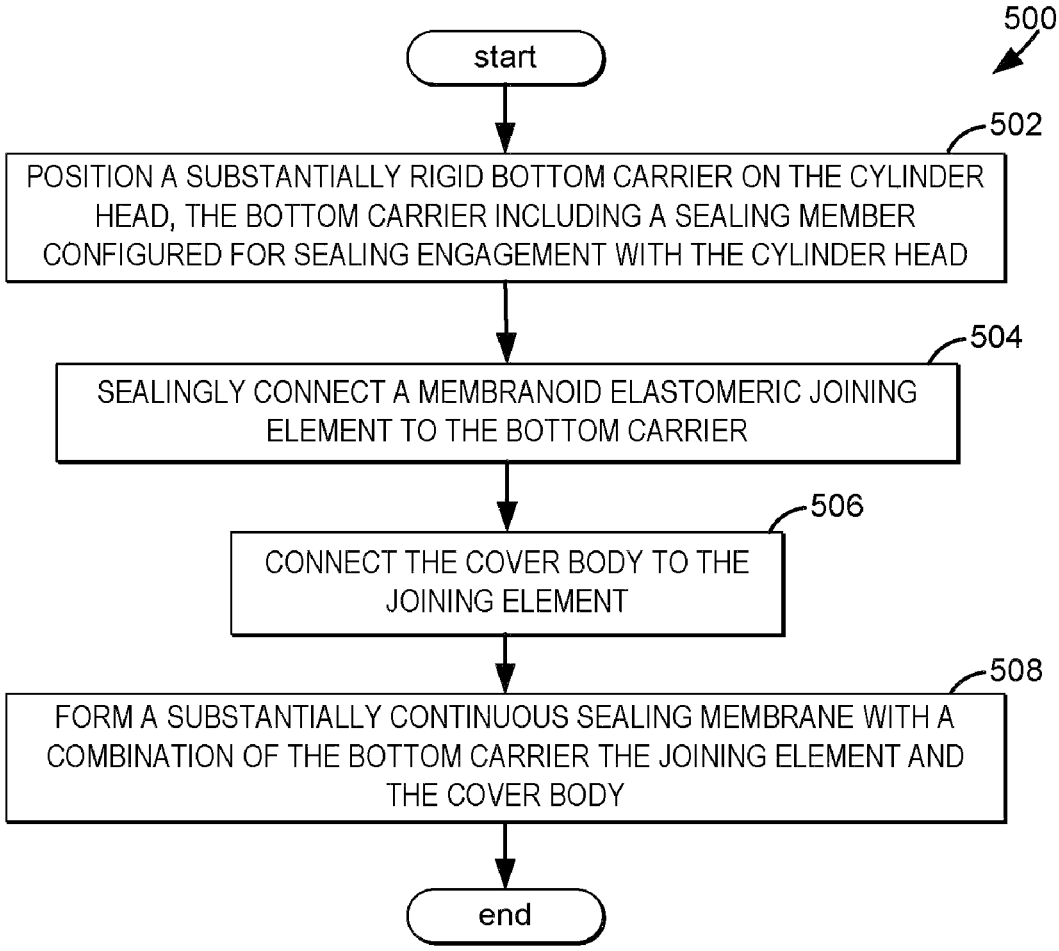
FIGS. 4 and 5 are flow charts illustrating various methods to seal a cylinder head, and to isolate NVH.

FIG. 4 is a flow chart illustrating a method 500 that may be implemented to seal a cylinder head and to isolate cylinder head vibrations from a cylinder head cover body. The method 500 may be implemented via the components and systems described above, but alternatively may be implemented using other suitable components. Method 500 may include, at 502, positioning a substantially rigid bottom carrier on the cylinder head, the bottom carrier may include a sealing member configured for sealing engagement with the cylinder head. The method 500 may include, at 504, sealingly connecting a membranoid elastomeric joining element to the bottom carrier. The method may also include, at 506, connecting the cover body to the joining element. In addition, the method may include, at 508, forming a substantially continuous sealing membrane with a combination of the bottom carrier the joining element and the cover body.

Figure 5:
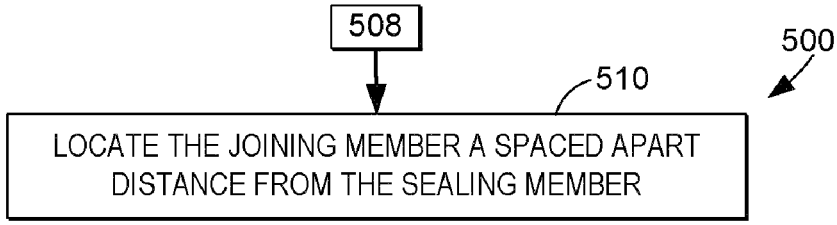

FIG. 5 is a flow chart illustrating an example variation of the method 500. Following from 508 the method 500 may include, at 510, locating the joining member a spaced apart distance from the sealing member.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A cylinder head cover for an internal combustion engine comprising:

a bottom carrier having a first end configured to be disposed in sealing engagement with a cylinder head, the bottom carrier further having a second end;

a cover body configured to provide a covering surface and having a side wall extending toward the cylinder head; and a resilient joining element connecting the bottom carrier second end to an edge of the cover body side wall in sealing engagement, wherein the resilient joining element has opposing joining surface profiles that matingly fit with a corresponding feature of the bottom carrier and the cover body, wherein the opposing joining surface profiles and the corresponding feature of the bottom carrier and the cover body are contained within an interior space between continuous inner and outer side walls of the cylinder head cover.

2. The cylinder head cover of claim 1, wherein the joining element has a membranoid structure.

3. The cylinder head cover of claim 1, wherein a combination of the bottom carrier, the joining element and the cover body form a substantially continuous seal over the cylinder head, wherein the combination of the bottom carrier, the joining element and the cover body from a dome over the cylinder head, and wherein the continuous inner and outer side walls respectively form an inner surface and an outer surface of the dome.

4. The cylinder head cover of claim 1, wherein the joining element has a joining element thickness, and a bottom carrier side wall and the cover body side wall have a side wall thickness substantially equal to the joining element thickness, and wherein an inner and outer surface of the joining element thickness is flush with both inner and outer surfaces of each of the side walls of the bottom carrier and the cover body.

5. The cylinder head cover of claim 1, wherein the bottom carrier second end is bonded to the joining element at a joining element first edge, and the cover body side wall is bonded to the joining element at a joining element second edge.

6. The cylinder head cover of claim 1, wherein the bottom carrier is configured to couple with and/or partially house a gasket, the gasket being held adjacent the cylinder head in sealing engagement with the cylinder head.

7. The cylinder head cover of claim 1, wherein the joining element provides at least some vibration isolation between the bottom carrier and the cover body at a spaced apart distance from the bottom carrier first end.

8. The cylinder head cover of claim 1, wherein the opposing joining surface profiles of the joining element has a first edge for coupling with the bottom carrier, and wherein one of the bottom carrier second end and the joining element first edge has a notched profile and the other of the bottom carrier second end and joining element first edge has a first protrusion configured to matingly fit within the notched profile.

9. The cylinder head cover of claim 8, wherein the opposing joining surface profiles of the joining element has a second edge opposite of the first edge, and the cover body side wall has a connecting edge, and wherein one of the joining element second edge or the side wall connecting edge has a notched profile and the other of the joining element second edge or the side wall connecting edge has a second protrusion configured to matingly fit within the notched profile.

10. A cylinder head covering system for covering a cylinder head of an internal combustion engine comprising:

a substantially rigid bottom carrier configured for sealing engagement at a first end with the cylinder head, the bottom carrier having an extension portion extending away from the cylinder head toward a second end disposed a distance from the first end;

a joining element having a first edge fastened to the bottom carrier second end wherein the joining element first edge is the only edge fastened to the bottom carrier, the joining element having an opposite second edge forming a membrane between the first edge and the second edge, wherein the first and second edges include a mating feature, and being made from a resilient material; and a cover body fastened to the mating feature of the joining element second edge, wherein the joining element second edge is the only edge fastened to the cover body, wherein the extension portion of the bottom carrier, the joining element, and the cover body have continuous inner and outer side walls, and wherein the mating feature of the first and second edges of the joining element are only positioned between the continuous inner and outer side walls.

11. The cylinder head covering system of claim 10, wherein the bottom carrier, the joining element, and the cover body collectively form a sealing cover over the cylinder head.

12. The cylinder head covering system of claim 10, wherein the distance from the first end is sufficient to include a sealing housing configured to provide for the sealing engagement and to provide for a stiffening structure.

13. The cylinder head covering system of claim 12, wherein the stiffening structure includes a number of stiffening elements spaced along a perimeter of the bottom carrier.

14. The cylinder head covering system of claim 10, wherein the joining element has a joining element thickness and a cover body side wall has a side wall thickness substantially equal to the joining element thickness.

15. The cylinder head covering system of claim 10, wherein the joining element has a joining element thickness and the extension portion has an extension portion thickness substantially equal to the joining element thickness.

16. The cylinder head covering system of claim 10, wherein the bottom carrier is configured to couple with and/or partially house a gasket, the gasket being held adjacent the cylinder head in sealing engagement with the cylinder head.

17. The cylinder head covering system of claim 10, wherein the cover body is made from a thermoplastic.

18. The cylinder head covering system of claim 10, wherein the joining element provides a continuous vibration isolation layer along a perimeter of the cylinder head cover.

19. The cylinder head covering system of claim 10, wherein the joining element is made from an elastomeric material.

20. The cylinder head covering system of claim 10, wherein the bottom carrier includes a gasket housing configured to house a gasket configured to provide the sealing engagement of the bottom carrier with the cylinder head, the gasket housing including an inside wall configured to extend from the cylinder head, and an outside wall spaced from the inside wall and disposed substantially parallel with the inside wall, and a joining flange configured to join the outside wall to the inside wall, the extension portion made substantially integrally with the inside wall and having an inside surface disposed substantially coplanar with an inside surface of the inside wall.

21. The cylinder head covering system of claim 20, further comprising one or more stiffening elements extending from the joining flange to the extension portion.

22. The cylinder head covering system of claim 10, wherein the cylinder head has a top surface that is substantially flat at an interface with the first end of the bottom carrier.

23. A cylinder head cover comprising an upper portion and a lower portion coupled together by a flexible joining element wherein the upper portion and the lower portion are coupled together only by the joining element at opposed connecting edges of the joining element, wherein the opposed connecting edges include a notched profile or a protrusion that matingly fits with a corresponding feature of the upper portion and the lower portion, and wherein inner and outer side walls of the upper portion are continuous with inner and outer side walls of the flexible joining element and with inner and outer side walls of the lower portion such that the notched profile or the protrusion matingly fit within a space between the inner and outer side walls.

24. The cylinder head cover of claim 23, wherein the joining element is disposed to form a continuous band around the cylinder head cover completely separating the lower portion from the upper portion.

25. The cylinder head cover of claim 23, further comprising a gasket configured to be held in sealing engagement with a cylinder head by the lower portion.

* * * * *